United States Patent [19]

Taig

[11] 4,038,998

[45] Aug. 2, 1977

[54] FLUID FLOW DIVIDER

[75] Inventor: Alistair Gordon Taig, Bristol, England

[73] Assignee: Bendix Westinghouse Limited, Bristol, England

[21] Appl. No.: 666,834

[22] Filed: Mar. 15, 1976

[30] Foreign Application Priority Data

Apr. 11, 1975 United Kingdom ..... 14889/75

[51] Int. Cl.[2] ..... F15B 13/043

[52] U.S. Cl. ..... 137/101; 137/625.62

[58] Field of Search ..... 137/101, 625.62, 625.63, 137/625.64

[56] References Cited

U.S. PATENT DOCUMENTS

| | | | |
|---|---|---|---|
| 2,737,196 | 3/1956 | Eames | 137/101 |
| 2,931,389 | 4/1960 | Moog, Jr. et al. | 137/625.62 |
| 3,033,221 | 5/1962 | Strader | 137/101 |
| 3,924,650 | 12/1975 | Parquet | 137/101 |
| 3,979,907 | 9/1976 | Paul | 137/101 X |
| 3,983,908 | 10/1976 | Bartholomaeus | 137/625.62 |

*Primary Examiner*—William R. Cline

*Attorney, Agent, or Firm*—Ken C. Decker; William N. Antonis

[57] ABSTRACT

A fluid flow divider having a fluid input port with passages therefrom to fluid flow paths leading to respective output ports. Said paths pass via regions acting on either side of a member which is thereby movable. Movement of said member increases a restriction in one said path while decreasing a restriction in the other said path. One of said paths further passes via a third restriction in a passage in said member such that in operation, in the event of fluid flow through the third restriction, the member is biased to concentrate flow of fluid from the input port to the one of the output ports which requires the greater fluid flow.

5 Claims, 1 Drawing Figure

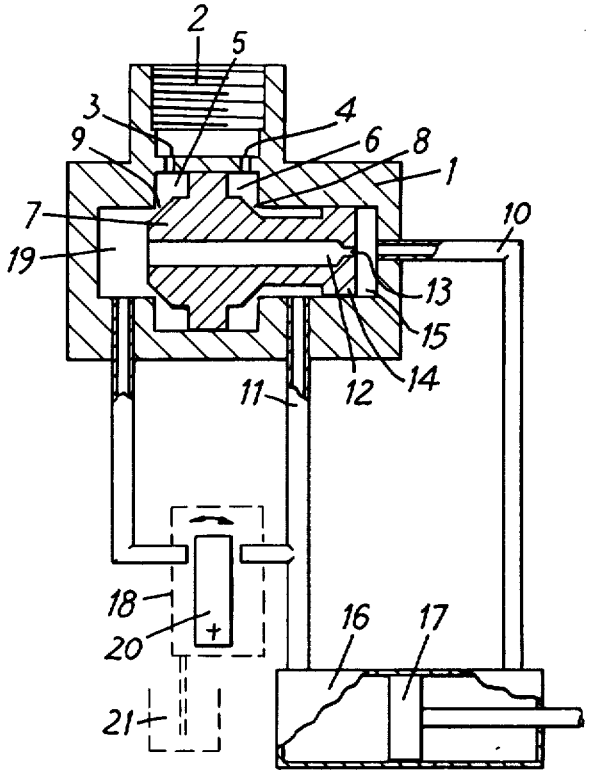
2
5
3
4
9
6
8
1
7
10
19
13
15
14
11
12
18
20
16
17
21

FLUID FLOW DIVIDER

This invention relates to fluid flow dividers and relates especially but not exclusively to fluid flow dividers for use in a fluid power assisted steering mechanism.

RELATED PRIOR ART

In the Specification of United Kingdom Pat. No. 1,431,437, there is described and claimed a hydraulic power assistance control device for providing power assistance for an effort exerted by a control part. The device has a fluid input port and a fluid outlet port, and a fluid flow divider for dividing fluid flow from the input port between two parallel fluid flow paths. The flow divider is such as to provide restriction in said paths and includes means whereby an increase of fluid pressure downstream thereof in one path relative to that in the other path is accompanied by an increased restriction in the latter path. The device further includes valve means having a first valve member displaceable by the control part relative to a further valve member in either of two directions from an intermediate position, and a respective pressure output port connected to each said path between the flow divider and the valve means. The valve members are so shaped as to, on the one hand, provide between then variable restrictions in each said path such that a said movement is effective to increase one restriction and, on the other hand, to provide between them respective reaction cavities in the flow path. The fluid pressures acting within the cavities produce reactions between the members which are transmissible to and counteracted by the control part.

OBJECT OF THE INVENTION

The flow dividers proposed by way of example, for use in the control device of the said United Kingdom Pat. No. 1,431,437 tend to be predominantly pressure responsive and one object of the present invention is to provide such a flow divider which when used in a hydraulic fluid power assistance device is more fluid flow dependent.

GENERAL DESCRIPTION OF THE INVENTION

According to the present invention there is provided a fluid flow divider having a fluid input port with passages therefrom to fluid flow paths to respective output ports, said paths passing via regions acting on either side of a member which is thereby movable to increase a restriction in one path whilst decreasing a restriction in the other path or vice versa and one said path further passing via a third restriction in a passage in said member such that in operation in the event of fluid flow in the third restriction, the member is biased in a direction to concentrate the flow of fluid from the input to the output port requiring the greater flow.

DESCRIPTION OF THE PREFERRED EMBODIMENT

In order that the invention may be more clearly understood and readily carried into effect, the same will be further described by way of example with reference to the accompanying drawing which illustrates in diagrammatical form, a power assistance arrangement utilising a fluid flow divider in accordance with the present invention.

Referring to the drawing, the fluid flow divider is provided with a main body 1 having an input port 2 for connection to a source of hydraulic fluid pressure typically a hydraulic pump driven from the engine of a motor vehicle. The port 2 is provided with a pair of passages 3 and 4 which communicate with a chamber which is separated into two regions 5 and 6 by a shaped movable member 7 which is movable between seats 8 and 9 and which, with the member 7, provide restrictions in respective flow paths from the input port 2 via passages 3 and 4 to respective output ports 10 and 11. It will be seen moreover that the path from the passage 3 to the output port 10 passes via a further passage 12 through the centre of the member 7 and that this passage further includes a restriction 13, the member being provided with an extension portion 14 which is a close fit in a bore 15 so as to substantially isolate the output port 10 of one path from the output port 11 of the other path.

By way of example, the flow divider is shown connected in a diagrammatical manner to a power assistance device having a cylinder 16 and a piston movable therein and denoted by the reference 17. One side of the piston 17 is connected to the output port 10 and the other side of the piston is connected to the output port 11. Also connected to the output port 11 is one side of a control valve device denoted by reference 18, the other side of the control device being connected to the region 19 on the left hand side of the member 7, that is at a point upstream of the restriction 13. The device 18 is diagrammatically represented by having a member 20 which is movable in one direction or the other to complementarily open or close apertures via which a certain amount of fluid flow is permitted to the sump 21 of the apparatus.

Referring now to the operation of the flow divider, assuming in the first instance that the hydraulic pump is operating and that a flow of fluid is therefore passing through the pasages 3 and 4 into the regions 5 and 6, with the member 20 of the control valve in a central position, and with no flow taking place to either side of the piston 17 of the power assistance device 16, a steady and substantially equal flow of fluid occurs via the restrictions between the member 7 and the seats 8 and 9 via the control valve to the sump 21. Assume however that due, for example, to slight movement of the member 20 to tend to increase the flow to the sump from one passage and reduce it from the other, the member 7 becomes unbalanced. Thus, assuming that there is a relative increase of pressure in the region 19, the member 7 tends to move to the right thereby tending to reduce the restriction at 9 and increase the restriction at 8. A flow of fluid via the passage 12 and the restriction 13 biasses the member 7 in a direction moreover which tends to close the restriction at 8 by seating the member 7 against the seat 8 such that all flow of fluid from the pump is concentrated into the passage 3 and the path via the restriction 13 to the output port 10 to provide for the movement of the piston 7 which takes place to tend to counteract the effect of the control device 20. Fluid displaced from the left hand side of the piston 7 out of the cylinder flows out through the control device 18 to the sump. When a stable position of the power assistance piston 17 is reached, that is where the pressures at the output ports 10 and 11 balance out the road forces, the flow through the passage 12 ceases and the flows through the two paths via passages 3 and 4 to the control device 20 again substantially equalise.

In the event of the piston 17 moving in the opposite direction to attain an equilibrium position, fluid flow takes place via the restriction 13 and the passage 12 in the opposite direction having the effect of biassing the member 7 in a direction to close off the restriction provided at the seat 9 thereby concentrating the flow of fluid from the input port 2 via the passage 4 and the maximally opened restriction at 8 to the output 11. Again, when the flow ceases at the equilibrium state of affairs of the power assistance system 17, the flow divider member 7 returns substantially to its central position such that the flow via the two paths are substantially equalised again.

I claim:

1. A fluid flow divider comprising:

a hollow body having first, second, third and fourth ports;

a hollow spool member reciprocably slidable within said hollow body and dividing the interior of said hollow body into first, second, third, fourth, and fifth volumes;

said first port being an inlet port for receiving pressurized hydraulic fluid;

said inlet port leading via first and second passages to said first and second volumes respectively;

a first part of said spool member hydraulically separating said first and second volumes;

said spool member being slidable between first and second extreme positions relative to said hollow body and being capable of resting at a third position intermediate said first and second positions;

a second part of said spool member cooperating with said hollow body to inhibit communication between said first and third volumes when said spool member is in said first position, and mutually communicating said first and third volumes when the spool member is in said second and third positions;

a third part of said spool member cooperating with said hollow body to inhibit communication between said second and fourth volumes when said spool member is in said second position, and mutually communicating said second and fourth volumes when said spool member is in said first and third positions;

a fourth part of said spool member hydraulically separating said fourth volume from said fifth volume;

a third passage passing through the body of said spool member between the ends thereof and communicating said third volume with said fifth volume; and a fluid flow restriction in said third passage;

said second port leading from said third volume to means for coupling said second port to a first side of a fluid flow control means;

said third port leading from said fourth volume to means for coupling said third port to a second side of said fluid flow control means and also to one side of a hydraulic power output piston;

said fourth port leading from said fifth volume to means for coupling said fourth port to the other side of said hydraulic power output piston.

2. The fluid flow divider of claim 1, wherein said second and third parts of said spool member are each a respective cone, each said cone tapering in the direction towards the respective nearer end of the spool member, and parts of said hollow body with which said second and third parts cooperate as aforesaid are circular and are the lesser-diameter edges of step-changes in the diameter of a bore forming the hollow of said hollow body.

3. The fluid flow divider of claim 1, wherein said fourth part of the spool member is a piston means subject to the relative difference in hydraulic pressures prevailing in said fourth and fifth volumes.

4. The fluid flow divider of claim 1 wherein the cross-sectional area of said second part of said spool member is substantially equal to the cross-sectional area of said fourth part.

5. A hydraulic power assistance arrangement including:

a hollow body having first, second, third and fourth ports;

a hollow spool member reciprocably slidable within said hollow body and dividing the interior of said hollow body into first, second, third, fourth, and fifth volumes;

said first port being an inlet port for receiving pressurized hydraulic fluid;

said inlet port leading via first and second passages to said first and second volumes respectively;

a first part of said spool member hydraulically separating said first and second volumes;

said spool member being slidable between first and second extreme positions relative to said hollow body and being capable of resting at a third position intermediate said first and second positions;

a second part of said spool member cooperating with said hollow body to inhibit communication between said first and third volumes when said spool member is in said first position, and mutually communicating said first and third volumes when the spool member is in said second and third positions;

a third part of said spool member cooperating with said hollow body to inhibit communication between said second and fourth volumes when said spool member is in said second position, and mutually communicating said second and fourth volumes when said spool member is in said first and third positions;

a fourth part of said spool member hydraulically separating said fourth volume from said fifth volume;

a third passage passing through the body of said spool member between the ends thereof and communicating said third volume with said fifth volume;

a fluid flow restriction in said third passage;

said second port leading from said third volume to means for coupling said second port to a first side of a fluid flow control means;

said third port leading from said fourth volume to means for coupling said third port to a second side of said fluid flow control means and also to one side of a hydraulic power output piston;

said fourth port leading from said fifth volume to means for coupling said fourth port to the other side of said hydraulic power output piston;

a fluid flow control means;

a hydraulic motor including a cylinder and a piston reciprocable within the cylinder, the piston having coupled thereto an output force transmitting piston rod;

said fluid flow control means having first and second hydraulic fluid receiving ports and a control member movable between said fluid receiving ports to control the relative quantities of hydraulic fluid passing through said receiving ports;

means coupling said first fluid receiving port to the second port of said fluid flow divider;

means coupling said second fluid receiving port to the third port of said fluid divider;

said cylinder of said hydraulic motor having first and second input ports respectively leading to either side of said piston;

means coupling said first cylinder input port to the third port of said fluid flow divider; and means coupling said second cylinder input port to the fourth port of said fluid flow divider;

movement of said control member varying the relative quantities of fluid leaving the second and fourth volumes of said fluid flow divider to cause the spool member of said fluid flow divider to move within the hollow body thereof to vary the fluid pressures at the third and fourth ports of said fluid flow divider and thereby apply different fluid pressures to either side of the piston of said hydraulic motor to cause an output power force to be transmitted along said piston rod in accordance with the movement of said control member.

* * * * *